United States Patent [19]

Uredat et al.

[11] Patent Number: 5,035,186

[45] Date of Patent: Jul. 30, 1991

[54] TABLE HAVING A CONNECTION DEVICE

[75] Inventors: Claus Uredat, Lindern; Wolfgang Ritter, Stuttgart, both of Fed. Rep. of Germany

[73] Assignee: Röder GmbH Sitzmöbelwerke, Frankfurt, Fed. Rep. of Germany

[21] Appl. No.: 319,149

[22] Filed: Mar. 3, 1989

[30] Foreign Application Priority Data

Mar. 5, 1988 [DE] Fed. Rep. of Germany ... 8802990[U]
Jul. 29, 1988 [DE] Fed. Rep. of Germany ... 8809657[U]

[51] Int. Cl.[5] ..... A47B 3/06

[52] U.S. Cl. ..... 108/159; 108/64; 108/114; 248/188

[58] Field of Search ..... 108/152, 64, 65, 114, 108/90; 248/289.1, 290, 188, 188.8; 312/198, 201, 111; 403/408.1, 406.1; 411/508, 509, 510, 908, 907; 24/297

[56] References Cited

U.S. PATENT DOCUMENTS

| | | | |
|---|---|---|---|
| 3,037,596 | 6/1962 | Fordyce | 24/297 |
| 3,521,579 | 7/1970 | Stafford | 108/64 |
| 3,880,095 | 4/1975 | Clark et al. | 108/114 |
| 3,977,528 | 8/1976 | Berger | 108/64 |
| 4,101,233 | 7/1978 | McConnell | 108/159 X |
| 4,223,613 | 9/1980 | Yoshizawa | 108/64 |
| 4,579,473 | 4/1986 | Brugger | 24/297 |
| 4,679,510 | 7/1987 | Veyhl et al. | 108/64 |
| 4,712,757 | 12/1987 | Ahmann | 248/188 |

FOREIGN PATENT DOCUMENTS

| | | | |
|---|---|---|---|
| 2142470 | 8/1971 | Fed. Rep. of Germany | 108/159 |
| 2142270 | 3/1973 | Fed. Rep. of Germany . | |
| 2238451 | 3/1975 | France | 108/64 |

*Primary Examiner*—Peter A. Aschenbrenner
*Attorney, Agent, or Firm*—Frishauf, Holtz, Goodman & Woodward

[57] ABSTRACT

On a table (10), a support element (14, 15) is provided on the table leg (13) and below the tabletop (11). This support element is pivotable about the vertical axis of the table leg (13). When the support element (14, 15) is pivoted outward, it can serve as a support for a tabletop (21) and is formed accordingly. The tabletop (21) has an elongated engagement element (24) on its underside, which element upon connection positively engages the inside of a corresponding elongated recess (23) of the support element (14, 15). A table connection formed in this way is very stable, and makes it possible for the thus-formed table arrangement to be moved about practically like a rigid unit. Also, it is possible for a single person without additional help, using this connection device, to couple one table (10) to an adjacent tabletop (21).

28 Claims, 10 Drawing Sheets

TABLE HAVING A CONNECTION DEVICE

The invention relates to a table having a connection device for connecting the table to an adjoining tabletop, suspended top, or the like.

A table of this kind is known from European Disclosure Document 0 264 589. There, a retention lever that can be pivoted outward is provided in the vicinity of the table edge. A suitable opening and a fastening element are built into the table for which the connection is thus intended. This kind of apparatus is complicated, and it permits connections between adjacent tables only in precisely predetermined directions.

A table having a connection device is also known from German Utility Model 87 12 124. There, a frustoconical connection element is fastened to the upper end of one table leg and supports the tabletop. This element protrudes laterally somewhat beyond the tabletop, so that an adjoining tabletop can be laid on it there. However, as long as the adjacent tabletop has not been placed on this element, the element has an unattractive appearance.

It is therefore an object of the invention to devise a table having a connection device that is practical, logical and attractive, so that it meets with the necessary customer acceptance.

According to the invention, this object is attained by means of a table having a connection device for connecting the table to an adjacent tabletop, suspended top or the like, which is characterized in that in the region of a table leg and below the tabletop or side panel, a support element is provided that is pivotable about an at least approximately vertical axis, the top of which is formed for supporting a tabletop, suspended top, table frame element or the like, and which in an outwardly pivoted position serves as a support for an adjacent tabletop, suspended top, frame element or the like. The result is a practical arrangement which is also pleasing to the eye and—which is of great practical importance—permits operation by a single person; that is, only a single person is required in the invention to attach suspended tops. This has proved very important in practice, because often a building superintendent in a convention meeting hall, for instance, must rearrange tables continually and change their size and configuration, as requested by the renters.

Further details and advantageous features of the invention will become apparent from the exemplary embodiments described below and shown in the drawing, which are in no way to be understood as a limitation of the invention, and from the dependent claims. Shown are:

FIG. 1, a three-dimensional view of a first exemplary embodiment of a table according to the invention and a suspended top to be connected to it;

Figure 1:
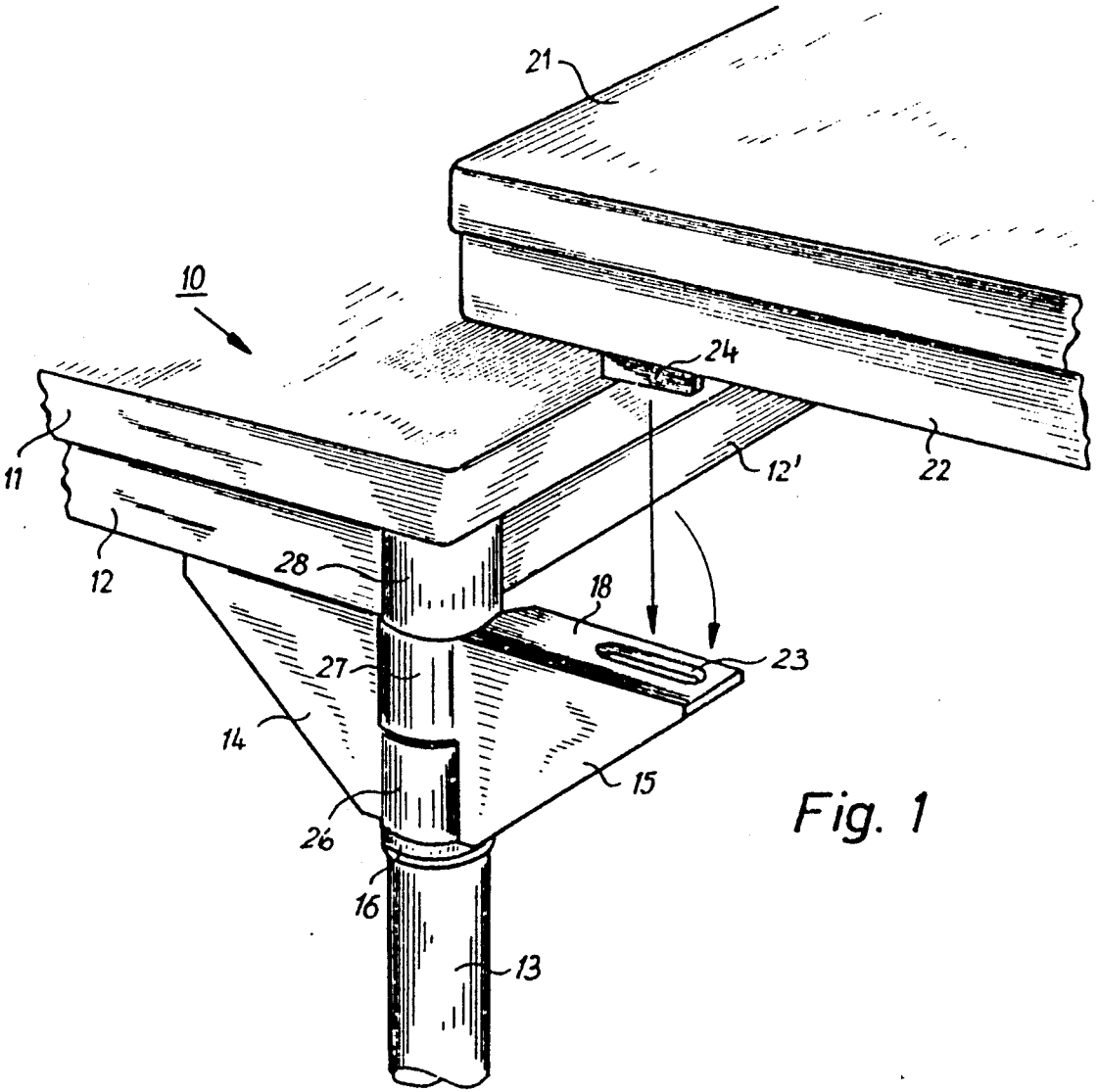

FIG. 1 shows a table 10 with a tabletop 11, a frame element 12, 12' and a table leg 13, which is formed as a circular-cylindrical tube and extends at least generally vertically, when the table—as usual—stands on a horizontal surface.

Two support elements 14, 15 are rotatably arranged on this table leg 13 and supported from below, for instance by means of a support ring 16 that is secured on the tube 13. Both support elements 14, 15 are pivotable about 360° about the tubular table leg 13, which forms a vertical pivot shaft. Both support elements, in this exemplary embodiment, have the shape of an approximately isosceles triangle in side view; one side of the triangle, as seen by an observer, rests against the table leg 13, and the other side forms the top 18 resting either against the frame element 12, 12' of the table 10 itself, as is shown for the support element 14, or can be folded out, as shown in FIG. 1 for the support element 15, in which case it forms a support for an adjacent suspended top 21 or its frame element 22. In the unfolded-out position, the support elements 14, 15 form an organic unit with the table and therefore are not particularly noticeable.

For connection with the suspended top 21, an oblong slot 23 is provided in the support 18, and an engagement element 24 of relatively hard rubber, plastic or the like, of approximately complementary shape to the oblong slot 23, is secured on the frame element 22 of the suspended top 21; once the tabletop 21 is laid in place, this engagement element 24 can engage the oblong slot 23. The preferred embodiment of the engagement element will be described in detail below, in conjunction with FIGS. 16–21.

Suitably, the engagement element 24 may be somewhat enlarged on its free end, so that it will lock into place in the oblong slot 23; or, it may widen toward the top, so that it will clamp in place in the oblong slot 23. A locking of the engagement element 24 in the oblong slot 23 is also intrinsically possible, and instead of an oblong slot a round hole, for instance, could be provided, along with a corresponding round engagement element; however, the oblong shape has substantial advantages.

As FIG. 1 shows, the support element 14 has a tubular portion 26, which surrounds the tubular table leg 13, and located above this portion 26 is a tubular portion 27 of the support element 15, which likewise surrounds the tubular table leg 13. The portions 26 and 27 serve to journal the support elements 14, 15 on the table leg 13. Suitably, the support elements 14, 15 are produced as die-cast parts, for instance of aluminum. A terminal element 28 is attached to the tube 13 above the portion 27 and visually appears to be part of the frame elements 12, 12'.

Figure 2:
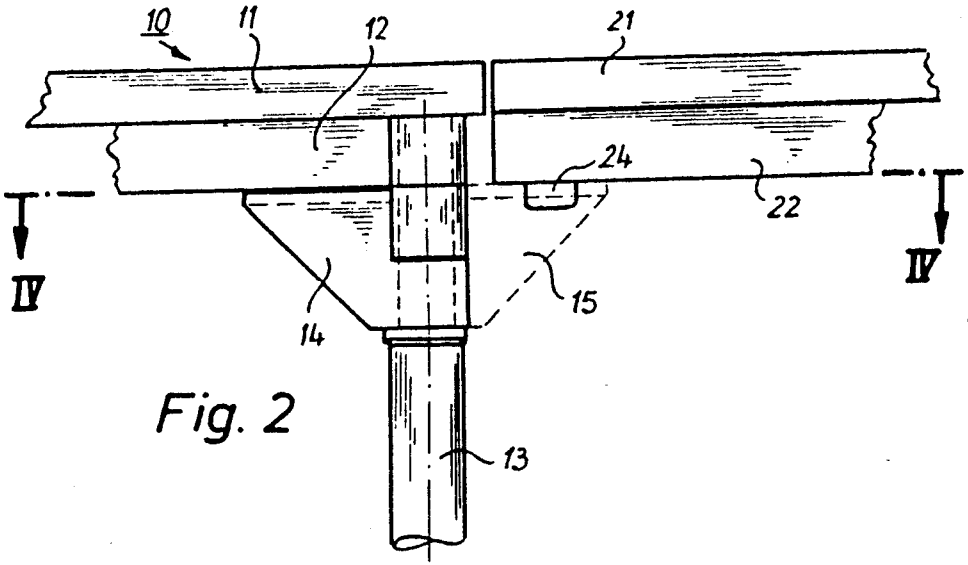
FIG. 2 is a side view of the arrangement of FIG. 1, in which the suspended top is joined to the table.

FIG. 2 shows the fastening of the suspended top 21, or its frame element 22, on the support element 15; the engagement element 24 engages the oblong slot 23 and with it forms a releasable connection.

Figure 3:
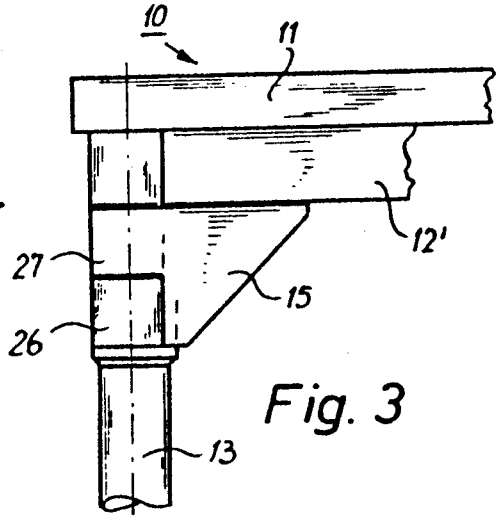
FIG. 3 is a view of the table having a connection device in the folded-in state.

FIG. 3 shows the table 10 from the side of the tabletop 21, with the support element 15 folded in and located beneath the frame element 12'

Figure 5:
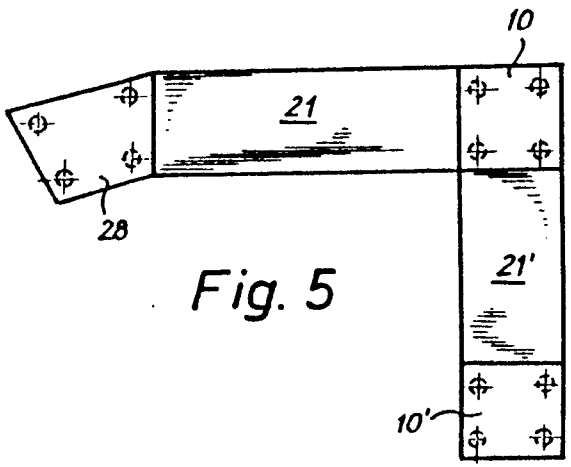
FIG. 5 is a view of the connection of three supporting tables with two suspended tops.
Figure 4:
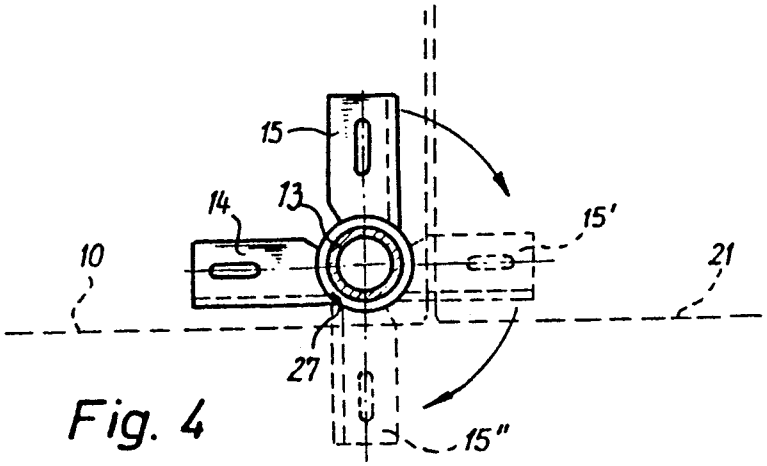
FIG. 4 is a plan view along the line IV—IV of FIG. 2.

FIG. 4, in solid lines, shows the support elements 14, 15 in their positions of repose, in which they are located underneath the frame elements 12, 12'. Dashed lines also show two possible positions 15' and 15'' of the support element 15. The support element 15 locks into place in these positions, as it also does in its position of repose. Further locking positions are also possible, such as for trapezoidal tables, one of which is shown in FIG. 5. For the locking, any known detent device may be used, such as a spring-loaded ball that snaps into place in a corresponding matching groove.

FIG. 5 shows the arrangement of two suspended tabletops 21, 21'. Reference numeral 28 identifies a trapezoidal table, and the suspended tabletop 21 is located between it and a square table 10. The suspended tabletop 21' is also located between the square table 10 and a second square table 10'. In this way, manifold possibilities for assembling tables as needed are obtained. It is particularly favorable in the invention that—unlike before—two persons are not needed to assemble such table groups; a single person alone is capable of making the necessary manipulations, because laying of the suspended tables 21, 21' on the pivoted-out support elements 14 or 15 can be done by a single person without difficulty.

Figure 6:
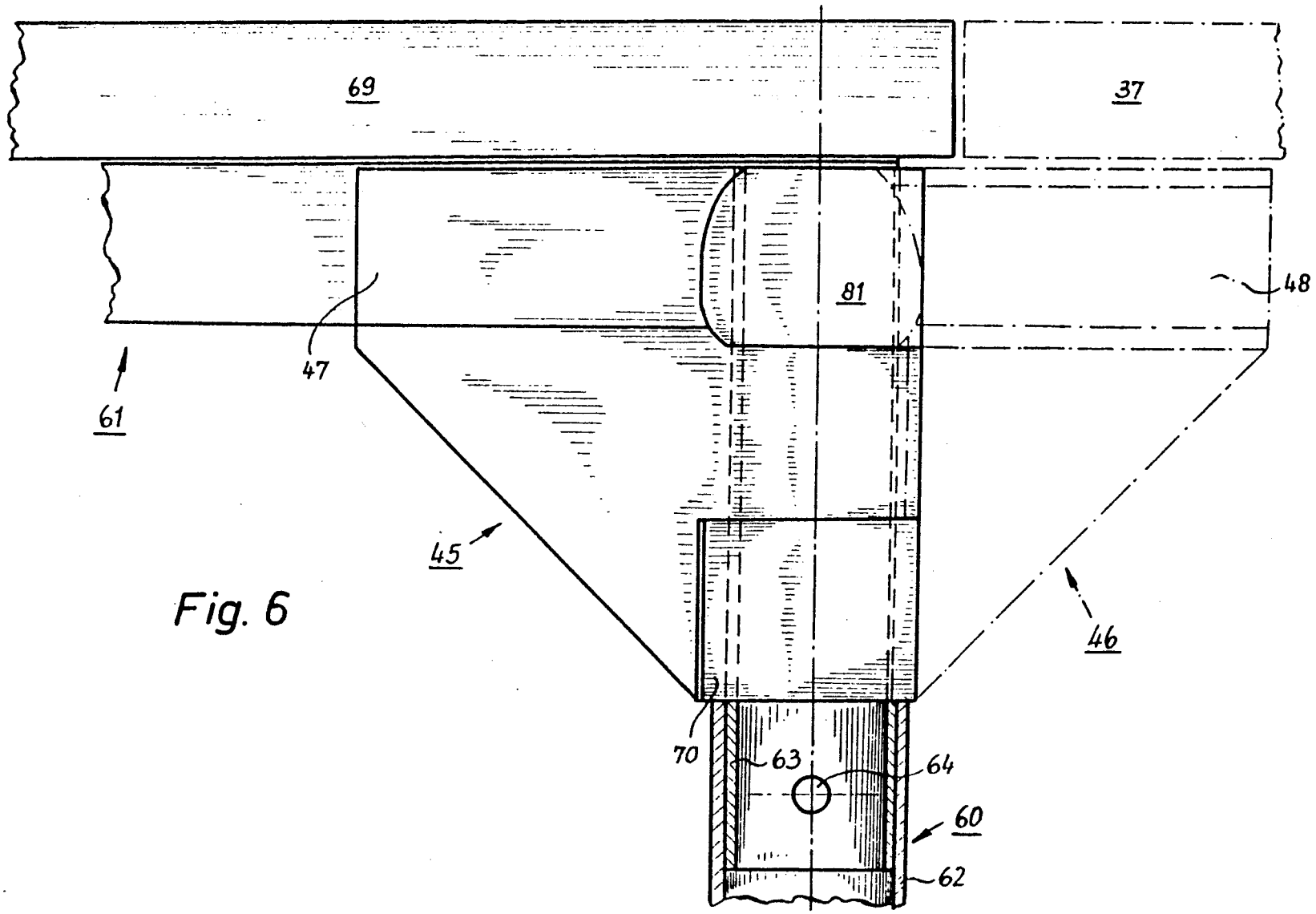
FIG. 6 is a side view of a second exemplary embodiment, in which one connection device in a folded-out position is shown in dot-dash lines.
Figure 7:
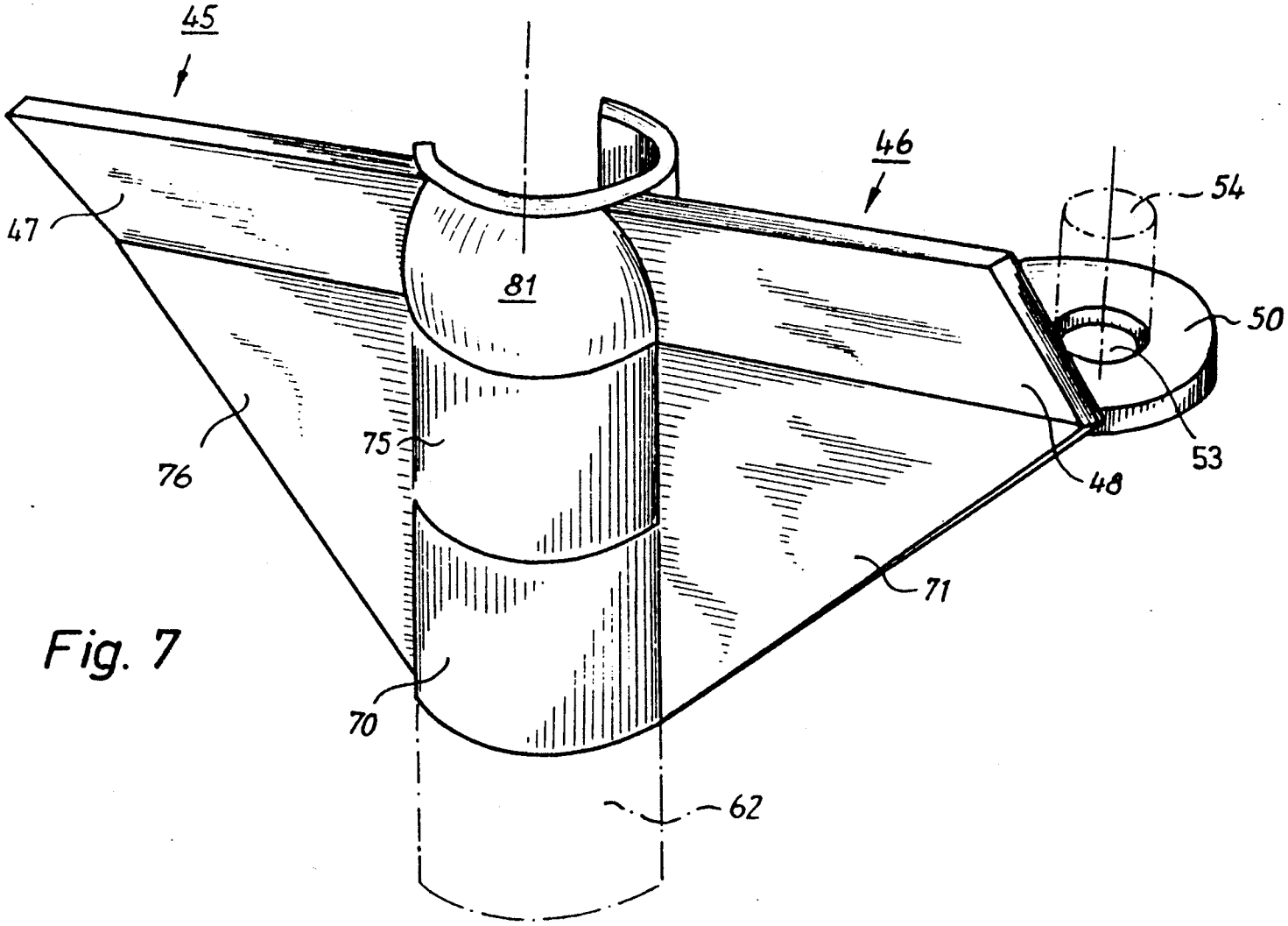
FIG. 7 is a three dimensional view of the connection devices used the table of FIG. 6.
Figure 8:
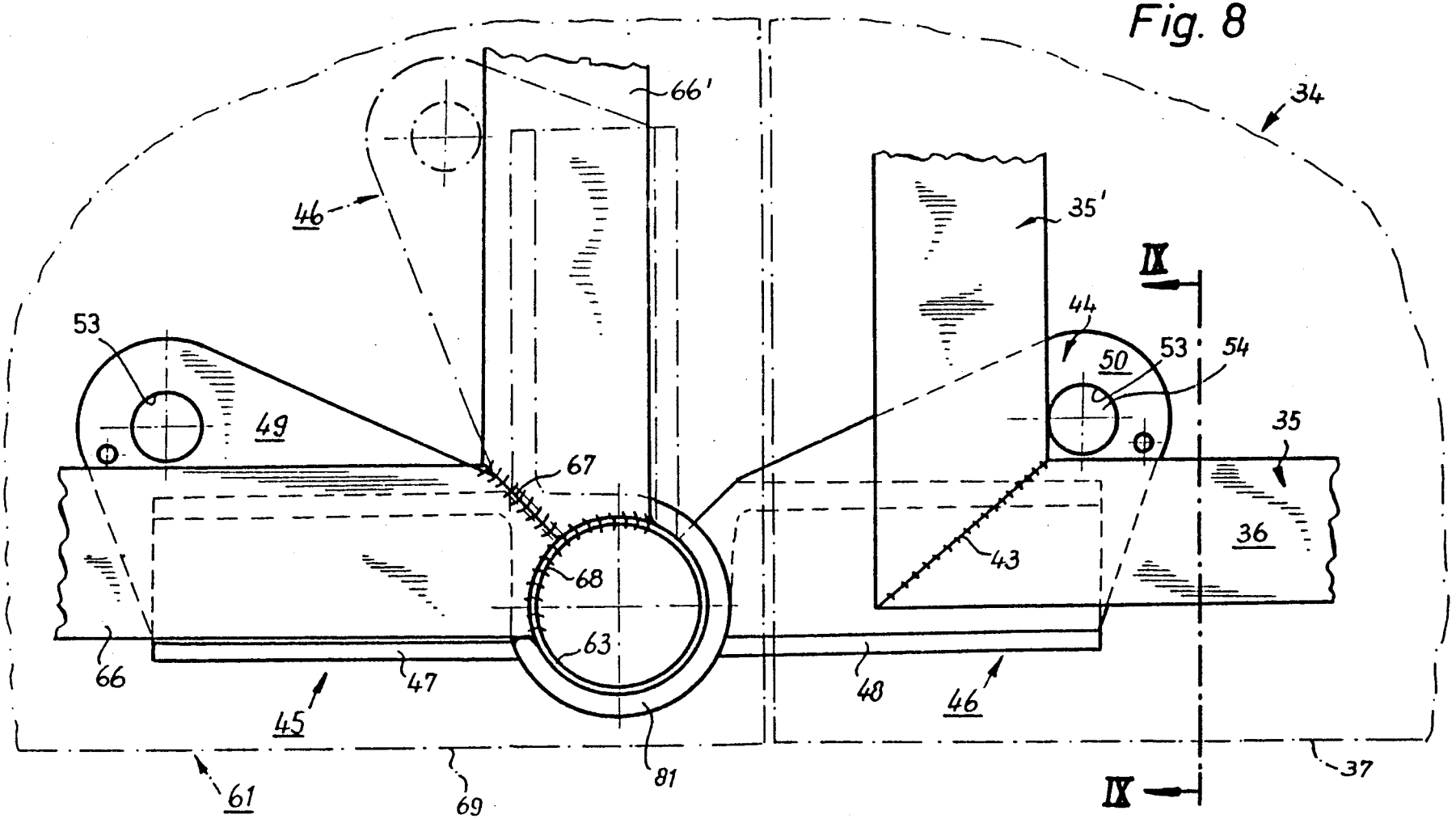
FIG. 8 is a section taken along the line VIII—VIII of FIG. 9.
Figure 9:
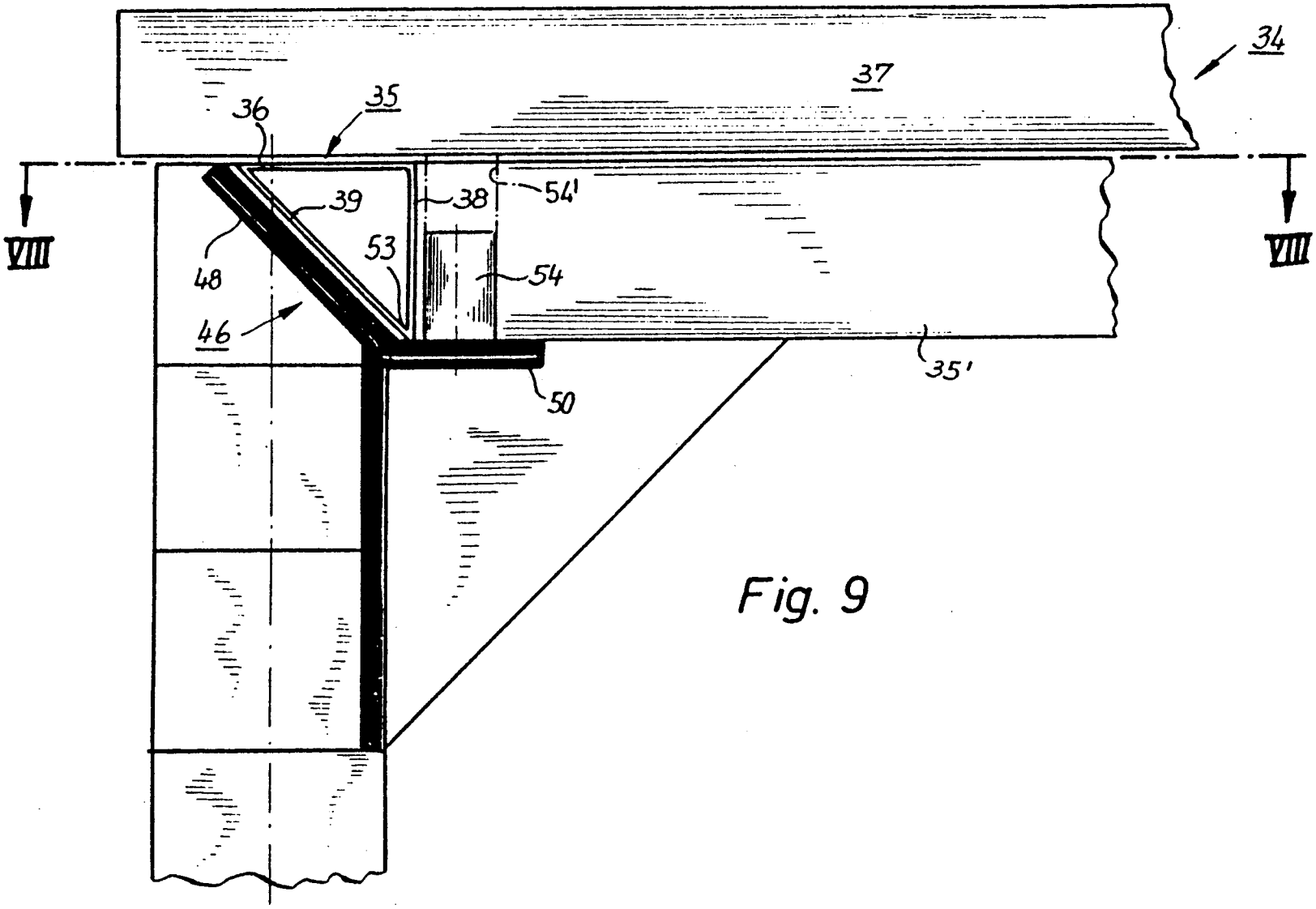
FIG. 9 is a section taken along the line IX—IX of FIG. 8.
Figure 11:
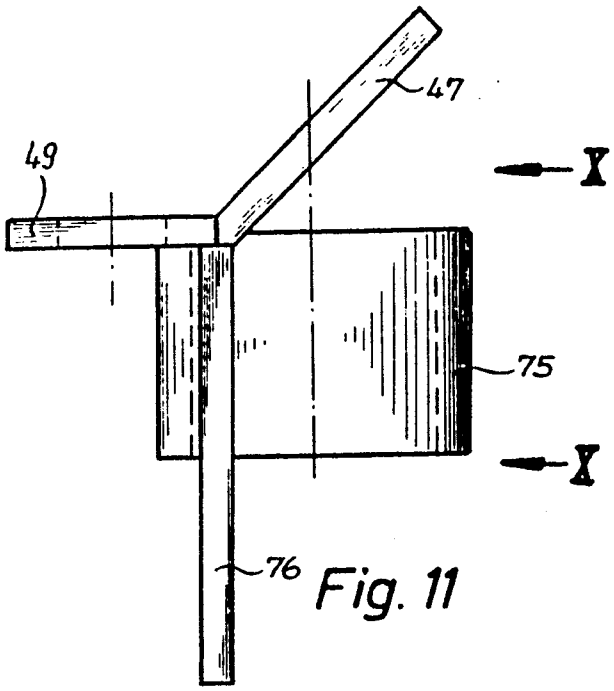
FIG. 11 is a side view seen along the arrows XI of FIG. 10.
Figure 10:
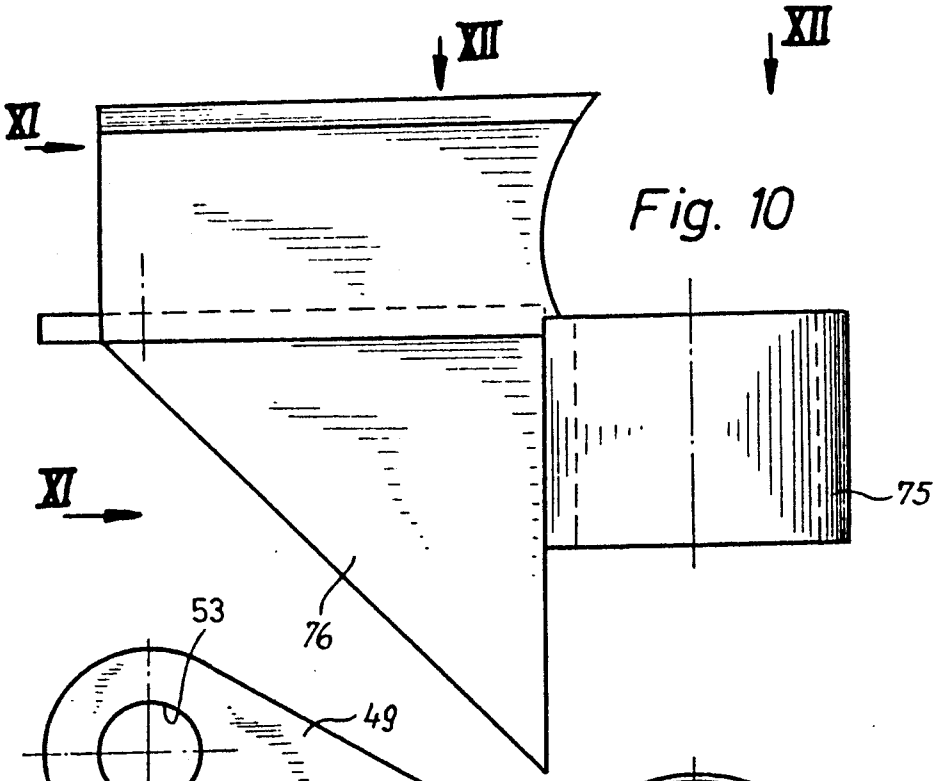
FIG. 10 is a side view of a connecting element, seen along the arrows X of FIG. 11.
Figure 12:
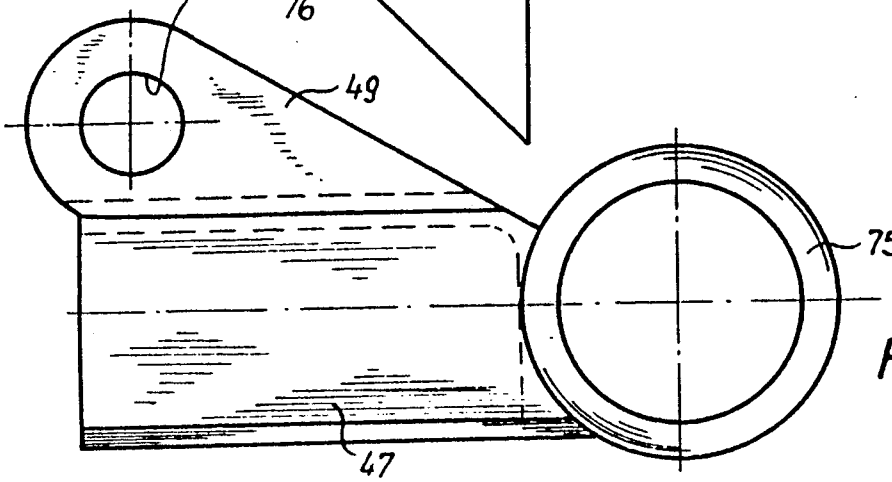
FIG. 12 is a plan view from above, seen along the arrows XII of FIG. 10.

This is also true for the second exemplary embodiment, as shown in FIGS. 6–15. This exemplary embodiment is fundamentally suitable for all table shapes, but particularly for suspended tables 34, the frame element 35 of which, as shown in FIG. 9, has a triangular cross section. As shown, this is an isosceles right triangle, with one side 36 of the right angle forming the support for the tabletop 37 and the other side 38 facing the inside of the table, and the base 39 of the triangle, as shown, extending diagonally from the top outside to the bottom inside. A frame element shape of this kind is sometimes preferred for visual reasons, because it gives the table or suspended top an attractive appearance. As shown in FIG. 8, this frame element 35 is welded via a weld seam 43 in the vicinity of one corner of the suspended top 34 to a frame element 35 adjoining it at a right angle, so that the frame elements 35 and 35' together form a right-angled inside corner 44.

Naturally this inside corner 44 could also be formed by some other arbitrary brace, such as a piece of wood of suitable shape screwed to the underside of the top 37, and this piece for instance may likewise have an oblique outer face 39.

The support elements 45 and 46, as shown in FIG. 8 in plan view and in FIG. 7 in three-dimensional form, are adapted to this special shape of the oblique face 39 and to this end each have an obliquely extending support face 47 and 48, respectively, which as shown in FIG. 9 rests against the oblique face 39 and supports it. Naturally, instead of an oblique support face, a plurality of support points would suffice to define the oblique face 39, as will readily be understood by one skilled in the art.

At the bottom, the oblique support faces 47, 48 are adjoined by respective horizontal portions 49 and 50. In the event that a suspended tabletop 34 is involved, FIG. 9 shows for instance that the frame element 35 rests with its lower edge 53 on the horizontal portion 50 of the support element 46.

For positive fastening, a vertical element 54 is also used. As an alternative, it may be fastened to the horizontal portion 50 and may protrude upward away from it. In that case, in the assembled state it rests against the inner side 38 of the frame element 35 and likewise against the inner side of the frame element 35'; see FIG. 8. In another alternative, this part may be secured to the underside of the suspended top 34, as indicated by dot-dash lines 54' in FIG. 9, and in that case with its free end it engages the recess 53 provided for it. This second alternative is preferred.

As FIG. 8 shows, the oblique support face 48 in combination with the horizontal portion 50 and the part 54 produces a secure, positive engagement between the frame element 35, 35' and the support element 46, especially if the part 54' is secured on the suspended top 34 and protrudes into the recess 53.

Just as in the first exemplary embodiment, the two support elements 45 and 46 in the second exemplary embodiment are secured such that they are pivotable outward on a table leg 60 of a table 61, and they lock in various rotational positions. The table leg 60 has a lower tube 62, in which a tube 63 of smaller diameter is secured, for instance by means of a transverse pin 64, and the support elements 45 and 46 are rotatably located on this tube 63. As FIG. 8 shows, the table 61 likewise has frame elements 66, 66' of triangular cross section which extend at right angles to one another and are welded together where they meet via a weld seam 67 and are welded to the inner tube 63 via a weld seam 68. The table 61 has a tabletop 69.

Figure 14:
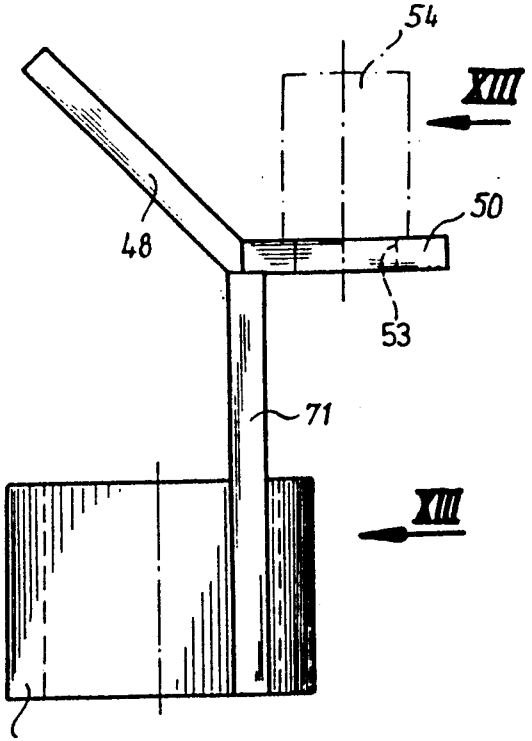
FIG. 14 is a side view seen along the arrows XIV of FIG. 13.
Figure 13:
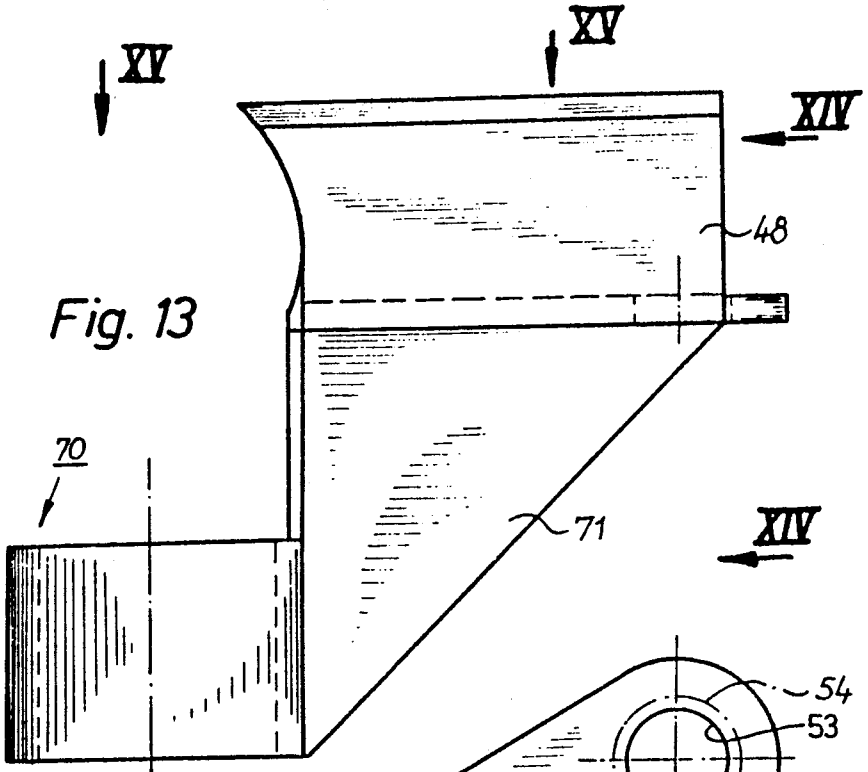
FIG. 13 is a side view seen along the arrows XIII of FIG. 14.
Figure 15:
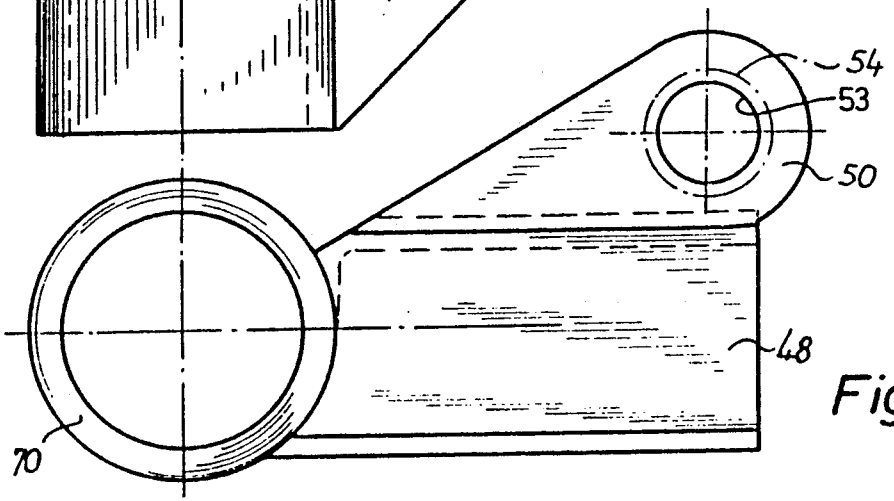
FIG. 15 is a plan view seen along the arrows XV of FIG. 13.
Figure 16:
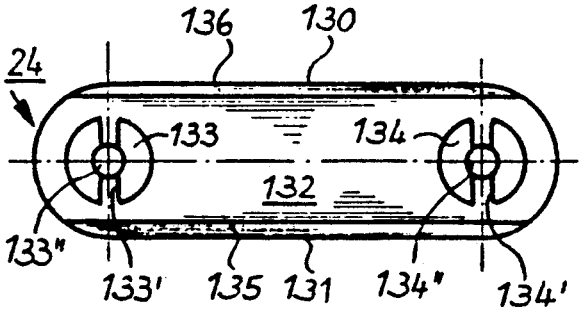
FIG. 16 is a view of a preferred embodiment of an engagement element according to the invention, seen in the direction of XVI of FIG. 17.

As shown for instance in FIG. 7 and in FIGS. 13–15, the support element 46 has a tubular portion 70 which is rotatably supported on the inner tube 63 (FIGS. 6 and 8) and is axially supported on the outer tube 62 (FIG. 6). In the manner clearly and unequivocally shown in FIGS. 13–16, which forms part of the disclosure, a triangular part 71 extends from this portion 70, merging at its upper, horizontal end with the oblique contact surface 48, on the one hand, and on the other hand with the horizontal portion 50, having the opening 53 provided in it for the pin 54'.

FIGS. 7 and 10–12 also show the support element 45 in all its details. This element likewise has a tubular portion 75, which is rotatably supported on the inner tube 63 (FIGS. 6 and 8) and is axially supported on the tubular portion 70. In the manner clearly and unequivocally shown in FIGS. 10–12, a manner that is intrinsic to the disclosure, a triangular part 76 extends from this portion 75, and as seen in FIG. 7 is symmetrical with the triangular part 71 and therefore protrudes downward past the annular part 70. At its upper horizontal end, the triangular part 76 merges on the one hand with the oblique support face 47 and on the other with the horizontal portion 49 (FIG. 8) at which an upwardly protruding part can likewise be secured, analogously to the part 54.

As FIG. 8 shows, the support elements 45 and 46 can be pivoted inward when not in use, so that with their oblique support faces they rest against the oblique faces of the frame elements 66 and 66', respectively.

For use, the support element required, for instance the support element 46 in FIG. 8, is pivoted outward, for instance into one of its locked positions. It is now ready for the placement on it of the suspended top 34; this suspended top 34 will naturally be placed on a total of four support elements; see FIG. 5.

For the apparent termination in the upper region, an annular segment 81 is used as shown in FIGS. 6–8; it is slipped onto the inner tube 63, or clipped to it, above the tubular portion 75.

FIG. 16–21 show an engagement element 24 in accordance with a preferred exemplary embodiment of the invention. Such an embodiment may naturally also be used for the engagement element 54'. The engagement element 24 has the shape in outline of an elongated oval, with two side edges 130, 131 parallel to one another, which define the maximum width of the engagement element 24.

The engagement element 24 has a base 132 for resting on the frame element 22, and extending from this base 132 are two spreadable protrusions 133, 134 each of which has an oblong slot 133', 134' and are penetrated by a longitudinal bore 133'', 134''. If a screw—not shown—is screwed into the bores 133'', 134'', then the screw spreads the spreading protrusions 133 and 134 apart, and thus anchors them in the frame element 22; see FIGS. 20 and 21.

Figure 19:
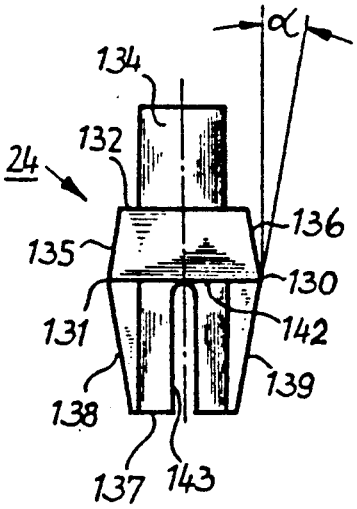
FIG. 19 is a side view of the engagement element of FIGS. 16–18, seen in the direction of the arrow XIX of FIG. 17.

As FIG. 19 shows particularly well, the cross section of the engagement element 24 increases, beginning at the base 132, up to the side edges 130, 131, in the course of which two oblique faces 135, 136 are formed, and then it decreases again to the free end 137 of the engagement element 24, again forming two oblique faces 138, 139. This is shown in great detail in FIGS. 16–19. As shown, the decrease is effected at an angle alpha, which is preferably on the order of magnitude of 10°.

Figure 17:
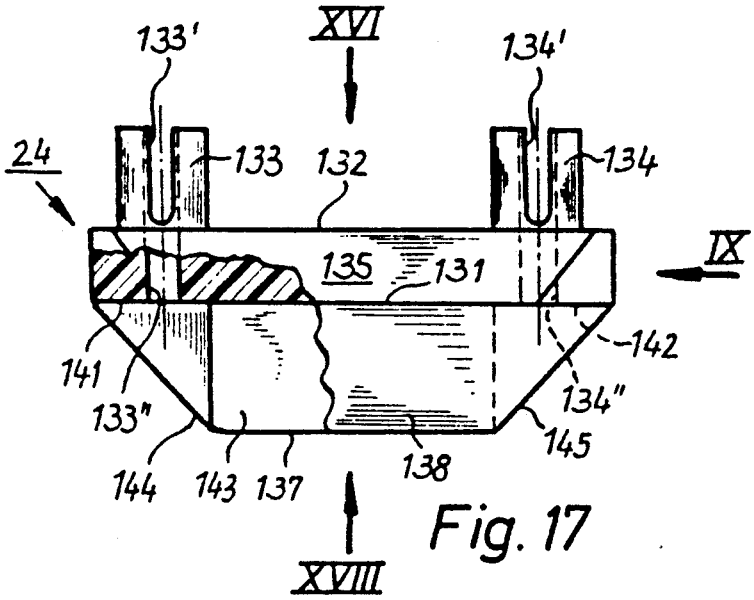
FIG. 17 is a side view of the engagement element of FIG. 16, seen partly in section.

Two recesses 141, 142 are also provided in the vicinity of the two longitudinal ends of the engagement element 24 and in the vicinity of the bores 133'', 134''; these recesses extend from the free end 137 to approximately the level of the side edges 130, 131, as shown particularly in FIG. 17. These recesses 141, 142 facilitate the introduction of screws into the bores 133'', 134'', as will readily be understood.

Also provided in the region of the longitudinal axis of the engagement element 24 is a longitudinal groove 143, which extends in the longitudinal direction from the recess 141 to the recess 142 and depth-wise extends from the free end 137 to approximately the level of the side edges 130, 131.

Figure 18:
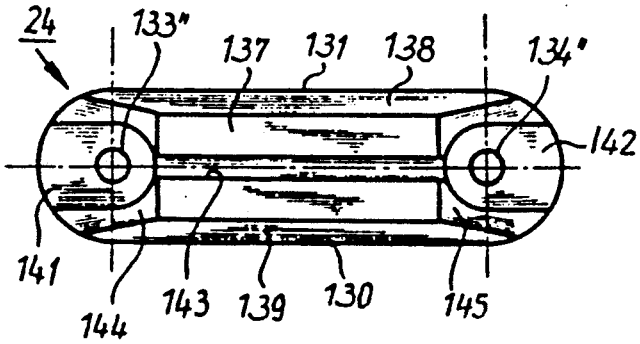
FIG. 18 is a view of the engagement element of FIGS. 16 and 17, seen in the direction of the arrow XVIII of FIG. 17.

In the vicinity of the two recesses 141, 142, the engagement element 24 also has a lateral chamfer 144 and 145 on either side, which extends obliquely from the free end 137 to approximately the level of the side edges 130, 131, as FIGS. 17 and 18 clearly show.

Mode of Operation

Figure 20:
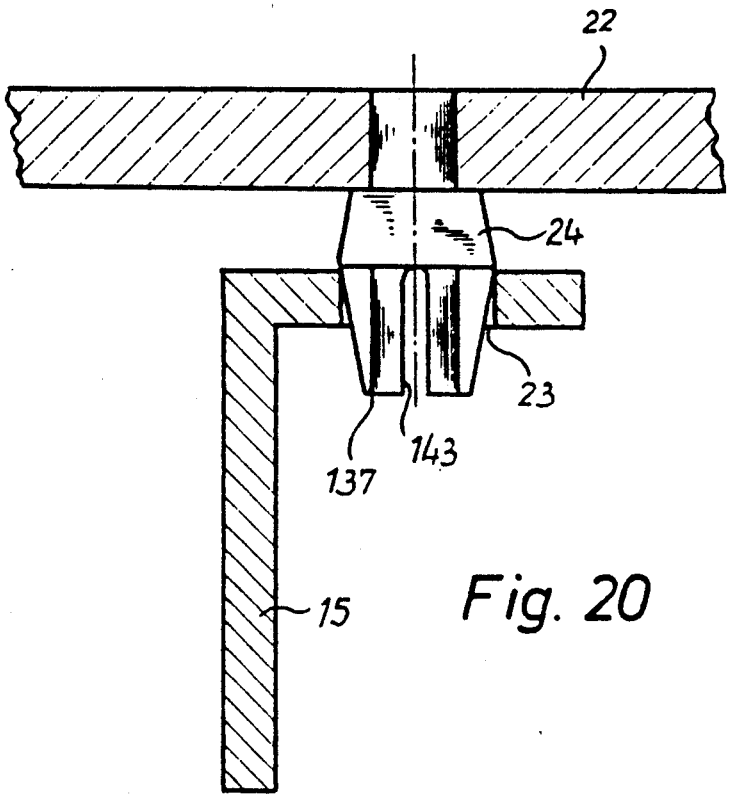
FIGS. 20 and 21 are schematic diagrams of the engagement of an engagement element according to the invention, with the view of FIG. 20 showing the preliminary engagement and the view of FIG. 21 showing the completed engagement.
Figure 21:
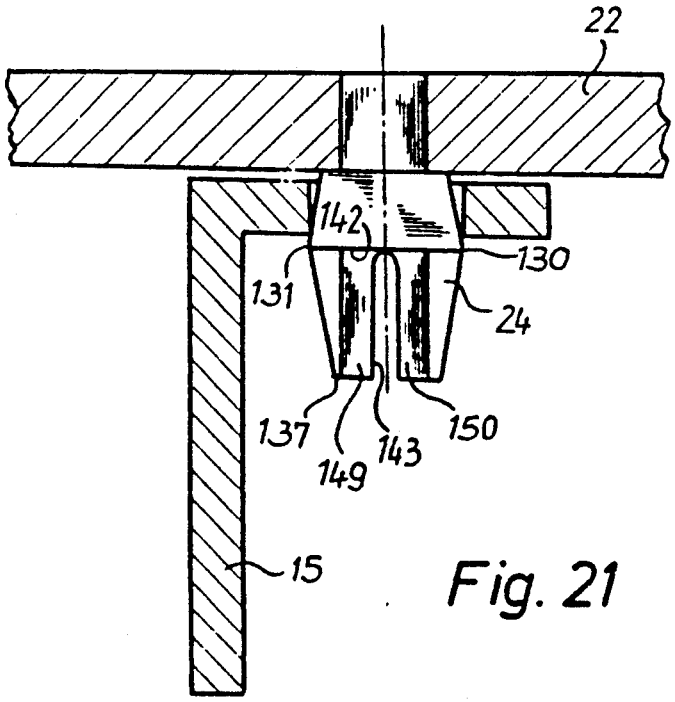

As FIG. 20 shows, the engagement element 24 secured to the frame element 22 is first introduced by the user into the recess 23 of the support element 15, in the course of which it centers itself with its oblique faces 138, 139, 144, 145. This is important, because it makes precise fitting work unnecessary Since the width of the recess 23 is slightly smaller than the spacing between the side edges 130, 131, the engagement element 24 initially rests with the side edges 130, 131 on the support element 15, without snapping into place, as FIG. 20 shows. The recess 23 may for instance have a width of 10 mm, while the spacing of the two side edges 130, 131 may be 10.5 mm. Next, as shown in FIG. 21, the engagement element 24 is made to snap into the recess 23, for instance by pounding on the suspended top 21 with a fist. This causes the side edges 130, 131, as shown in FIG. 21, to be located below the recess 23 of the support element 15. The longitudinal groove 143 enables a certain resiliency, in the snapping-in process, of the two sides of the engagement element 24, identified as 149 and 150 in FIG. 21. The engagement element is suitably produced from an elastic material, such as a polyamide, hard rubber or the like.

In dismantling the suspended top 21, the process is the reverse: First, for instance by pounding on it with a fist from below, the engagement element 24 is moved into the unlocked location shown in FIG. 20, in which it still rests on the support element 15. Once this has been done at all corners of the suspended top 21, the suspended top can be removed by a single person. This consequently makes one-man operation possible for both assembly and disassembly.

It is particularly advantageous that after the assembly the adjacent table elements (such as 28, 21 and 10 in FIG. 5) form a firm unit with one another, and the table element 21, for instance, cannot shift laterally relative to the table elements 10 or 28. The joined table elements behave virtually as if they were rigidly joined together. This is attained through the location and shape of the engagement element 24, in particular because the longitudinal axis of the engagement element 24 extends approximately parallel to the table frame element 22 to which it is secured and which is a longitudinal frame element of the table; see FIG. 1.

Because the engagement element 24 widens in the direction away from the free end, as shown in FIGS. 16–21, it can thus be easily threaded into and aligned in the associated elongated recess 23 of the applicable support element, without locking completely into place there. Only after the alignment is it then —because of its elastically resilient embodiment—brought by pressure from above completely into its final position, in which it firmly joins the tabletop to the adjacent table or the like. The connection is then quite stable and makes it possible to move about the thus-assembled table arrangement virtually in the same way as a rigid unit. Upon disassembly, proceeding in reverse, the engagement element can first be loosened from its locked-in position, while still continuing to rest on the support element of the adjacent table. Only once all the engagement elements of the applicable tabletop have been unlocked is the tabletop then lifted up and carried away. In this way, a single person is capable of both introducing and removing a tabletop; that is, one-man operation is made possible by the invention. With a view to economizing on the number of employees, this is of very great practical value.

Naturally, manifold changes and modifications may be made within the scope of the invention. For instance, the engagement element 24 may be provided—in a kinematic reversal—on the top of the support element 15, while the elongated recess is located in the frame element 22. The embodiment shown is preferred, however, because of its easier and especially logical assembly. Claims 11–18 also have independent significance on their own.

We claim:

1. A table having a connection device for connecting the table (10) to an adjacent tabletop, suspended top or the like (21; 37), characterized in that in the region of a table leg (13; 60) and below the tabletop (11; 21; 69) or frame element (12; 22; 47) of said table (10), a support element (14, 15; 45, 46) is provided that has a tubular segment (26, 27; 70,75) which is pivotable about an at least approximately vertical part (13; 63) of the table, also has a support extension portion, the top (18; 50) of which is formed for supporting a tabletop (11; 69; 21; 37), suspended top, table frame element or the like, serves as a support for an adjacent tabletop, suspended top, frame element or the like when said support element is in a position outwardly pivoted (15' 5'') about said at least approximately vertical part (13; 62) of the table, and is provided with a releasable, upwardly protruding part (54) for engagement in a corresponding recess (44) of the tabletop, suspended top, or frame element which is to be connected to said support element.

2. A table having a connection device for connecting the table (10) to an adjacent tabletop, suspended top or the like (21; 37), characterized in that in the region of a table leg (13; 60) and below the tabletop (11; 21; 69) or frame element (12; 22; 47) two outwardly pivotable support elements (14, 15; 45, 46) are provided, which are pivotable about the same axis and the tops (18; 50) of which are preferably located at the same level, said axis being at least approximately vertical, the top (18; 50) of each said support element being formed for supporting a tabletop, suspended top, table frame element or the like, and serving, when in an outwardly pivoted position (15', 15''), as a support for an adjacent tabletop, suspended top, frame element or the like and its top (18) each said support element (14, 15) is provided with a recess (23; 53) for receiving an engagement element (24; 54') which is approximately complementary to said recess (23; 53) and is provided on the tabletop or its frame element.

3. A table as defined by claim 1, characterized in that the support element (14, 15; 45, 46) is lockable into place in at least one rotational position (15, 15'').

4. A table as defined by claim 1, characterized in that the table leg (13; 60) at least in some portion includes a tube (13; 62, 63) of circular-cylindrical cross section, and that said support element (14, 15; 45, 46) is located rotatably on said tube.

5. A table, having a connection device for connecting the table (10) to an adjacent tabletop, suspended top or the like (21; 37), characterized in that in the region of a table leg (13; 60) and below the tabletop (11; 21; 69) or frame element (12; 22; 47) two outwardly pivotable support elements (14, 15; 45, 46) are provided, which are pivotable about an at least approximately vertical axis and pivotable about the same axis, and the tops (18; 50) of which are located essentially at the same level; in that the table leg (13; 60) at least in some portion includes a tube (13; 62, 63) of circular-cylindrical cross section, and in that the two support elements (14, 15; 45, 46) are located rotatably on said tube, a support ring (16) being provided on said tube (13) for supporting at least one said support (14).

6. A table having a connection device for connecting the table (10) to an adjacent tabletop, suspended top or the like (21; 37), characterized in that in the region of a table leg (13; 60) and below the table top (11; 21; 69) or frame element (12; 22; 47) two outwardly pivotable support elements (14, 15; 45, 46) are provided, which are pivotable about the same axis and the tops (18; 50) of which are preferably located at the same level, said axis being at least approximately vertical, the top (18; 50) of each said support element being formed for supporting a tabletop, suspended top, table frame element or the like, and serving, when in an outwardly pivoted position (15', 15''), as a support for an adjacent tabletop, suspended top, frame element or the like, the support element being provided with a releasable, upwardly protruding part (54) for engagement in a corresponding recess (44) of the tabletop, suspected top or frame element which is to be connected to said support element.

7. A table as defined by claim 1, characterized in that said extension portion of the support element (14, 15; 45, 46), in side view has approximately the shape of a triangle (71, 76), one edge of the triangle being substantially horizontal and joined to a top horizontal surface (18, 50) and another edge being substantially vertical and connected to said tubular segment of said support element.

8. A table as defined by claim 1, characterized in that the pivotable support element (45, 46), for lateral guidance of the tabletop, suspended top or the like (34) to be coupled to the table, is provided with a guide portion (47, 48) protruding obliquely upward from the top of said extension portion of said support element, a horizontal support surface being joined to said extension portion at its top (18, 50) and said guide portion extending obliquely outward from said support surface.

9. A table having a connection device for connecting the table (10) to an adjacent tabletop, suspended top or the like (21; 37), characterized in that in the region of a table leg (13; 60) and below the tabletop (11; 21; 69) or frame element (12; 22; 47) of said table (10), a support element (14, 15; 45, 46) is provided that, has a tubular segment (26, 27; 70, 75) which is pivotable about an at least approximately vertical part (13; 63) of the table, also has a support extension a tabletop (11; 69; 21; 37), suspended top, table frame element or the like, serves as a support for an adjacent tabletop, suspended top, frame element or the like, and is provided with a recess (23; 53) for receiving an engagement element (24; 54') which is approximately complementary to said recess (23; 53) and is provided on the tabletop (21) or its frame element (22).

10. A table as defined by claim 1, wherein said support element has a recess (23; 53) for receiving an engagement element (24; 54) provided on said table top

(21) or frame thereof (22), wherein said engagement element (24; 54'), viewed in cross section, at least in a sectional plane that is vertical with respect to its position in use, widens from its free end (137) initially up to a location (130, 131) of maximum cross section and then decreases again in cross section (faces 135, 136), and wherein said engagement element is resiliently deformable in said cross-sectional plane that is vertical with respect to the position of the engagement element when in use.

11. A table as defined by claim 10, characterized in that said location (130, 131) of maximum cross section has a maximum cross-sectional dimension in a direction parallel, at the time of use, to the orientation of said table top or frame therefor which dimension is greater than the dimension complementary to it of the recess (23; 53) intended for receiving the engagement element (24; 54') by an amount which can be accomodated.

12. A table as defined by claim 11, wherein the engagement element (24; 54') is produced from a resiliently elastic plastic, in particular a polyamide.

13. A table as defined in claim 12, wherein the engagement element (24; 54') is provided with a recess (143) having an elongated shape seen in the direction of its depth to increase its elasticity.

14. A table as defined by claim 13, wherein said engagement element is of elongated contour, being elongated in a direction perpendicular to said direction of maximum cross-sectional dimension, and extends from said table top or frame thereof to its said free end and wherein said elongated recess (143) extends in the direction of its depth from the free end (137) of the elongated engagement element (24) to approximately the level of said location (130, 131) of maximum cross section.

15. A table as defined by claim 14, wherein the elongated engagement element (24) has a chamfer (144, 145) in the region of each of its longitudinal ends, to facilitate its introduction into a corresponding elongated recess (23) in said support element.

16. A table as defined by claim 14, wherein the engagement element (24; 54') for fastening to a tabletop, suspended top (21), tabletop frame element (22) of the like, is provided, on a surface thereof fitting against said tabletop, suspended top, tabletop frame element or the like, with at least one spreadable protrusion (133, 134) having its end split by a recess (133', 134') for introducing a spreader element into this protrusion (133, 134).

17. A table as defined by claim 14, wherein the longitudinal axis of the elongated engagement element (24) extends at an angle, and preferably at least approximately a right angle, with respect to the table edge bordering on an adjacent table element (10) when assembled.

18. A table as defined by claim 1, characterized in that, in the region of a table leg (13; 60), two said pivotable support elements (14, 15; 45, 46) are provided, which are pivotable about a single said at least approximately vertical part (13, 63) of the table, tops (18; 50) of said two support elements being preferably located at the same level.

19. The table of claim 18, characterized in that the table leg (13; 60) at least in some portion thereof includes a tube (13; 62, 63) of circular-cylindrical cross section, and that both said support elements (14, 15; 45, 46) are located rotatably on said tube.

20. A table as defined by claim 4, characterized in that on the tube (13) a support ring (16) is provided for supporting said support element (14).

21. A table as defined by claim 19, characterized in that on the tube (13) a support ring (16) is provided for supporting both said support elements (14; 15).

22. A table as defined in claim 1, characterized in that said support element (46) has a recess for receiving a part (54') secured to said element (21; 37) to be coupled to said support element.

23. A table as defined by claim 2, wherein each of said two support elements has a recess (143) for receiving an engagement element provided on said table top (21) or frame thereof (22) and wherein said engagement element (24; 54'), viewed in cross-section, at least in a sectional plane that is vertical with respect to its position in use, widens from its free end (137) initially up to a location (130, 131) of maximum cross-section and then decreases again in cross-section, said engagement element being of elongated contour, being elongated in a direction perpendicular to said direction of maximum cross-sectional dimension, and extends from said table top or frame thereof to said free end and wherein said recess (143) has an elongated shape seen in the direction of its depth to increase its elasticity and extends in the direction in its depth from said free end of the elongated engagement element (24) to approximately the level of said location (130, 131) of maximum cross-section.

24. A table as defined by claim 23, wherein the elongated engagement element (24) has a chamfer (144, 145) in the region of each of its longitudinal ends, to facilitate its introduction into a corresponding elongated recess (23) in a said support element.

25. A table as defined by claim 23, wherein the engagement element (24; 54') for fastening to a table top, suspended top (21), table top frame element (22) or the like, is provided, on a surface thereof fitting against said table top, suspended top, tabletop, frame element or the like, with at least one spreadable protrusion (133, 134) having its end split by a recess (133', 134') for introducing a spreader element into this protrusion (133', 134').

26. A table as defined by claim 5, wherein each of said two support elements has a recess (143) for receiving an engagement element provided on said table top (21) or frame thereof (22) and wherein said engagement element (24; 54'), viewed in cross-section, at least in a sectional plane that is vertical with respect to its position in use, widens from its free end (137) initially up to a location (130, 131) of maximum cross-section and then decreases again in cross-section, said engagement element being of elongated contour, being elongated in a direction perpendicular to said direction of maximum cross-sectional dimension, and extends from said table top or frame thereof to said free end and wherein said recess (143) has an elongated shape seen in the direction of its depth to increase its elasticity and extends in the direction in its depth from said free end of the elongated engagement element (24) to approximately the level of said location (130, 131) of maximum cross-section.

27. A table as defined by claim 26, wherein the elongated element (24) has a chamfer (144, 145) in the region of each of its longitudinal ends, to facilitate its introduction into a corresponding elongated recess (23) in a said support element.

28. A table as defined by claim 26, wherein the engagement element (24; 54') for fastening to a table top, suspended top (21), table top frame element (22) or the like, is provided, on a surface thereof fitting against said table top, suspended top, table top, frame element or the like, with at least one spreadable protrusion (133, 134) having its end split by a recess (133', 134') for introducing a spreader element into this protrusion (133', 134').

* * * * *